US005674122A

United States Patent [19]

Krech

[11] Patent Number: 5,674,122

[45] Date of Patent: Oct. 7, 1997

[54] ABRASIVE ARTICLES AND METHODS FOR THEIR MANUFACTURE

[75] Inventor: John E. Krech, Eagan, Minn.

[73] Assignee: Minnesota Mining and Manufacturing Company, St. Paul, Minn.

[21] Appl. No.: 330,352

[22] Filed: Oct. 27, 1994

[51] Int. Cl.[6] ..... B24D 11/00

[52] U.S. Cl. ..... 451/536; 451/523; 51/298; 51/299

[58] Field of Search ..... 451/523, 526, 451/527, 536; 51/298, 299, 300

[56] References Cited

U.S. PATENT DOCUMENTS

| | | | |
|---|---|---|---|
| Re. 21,852 | 7/1941 | Anderson | 51/185 |
| 2,109,906 | 3/1938 | Lippitt | 51/190 |
| 2,123,581 | 7/1938 | Anderson | 51/185 |
| 2,288,002 | 6/1942 | Kingman | 51/294 |
| 2,740,239 | 4/1956 | Ball et al. | 51/185 |
| 2,838,890 | 6/1958 | McIntyre . | |
| 2,984,052 | 5/1961 | Mueller, Jr. | 51/188 |
| 3,861,892 | 1/1975 | Wisdom, Jr. et al. | 51/295 |
| 4,251,408 | 2/1981 | Hesse et al. | 51/298 |
| 4,606,154 | 8/1986 | Hermann et al. | 451/526 |
| 4,652,275 | 3/1987 | Bloecher et al. | 51/298 |
| 4,799,939 | 1/1989 | Bloecher et al. | 51/293 |
| 4,903,440 | 2/1990 | Larson et al. | 51/298 |
| 4,949,511 | 8/1990 | Endo et al. | 51/295 |
| 4,967,760 | 11/1990 | Yarbrough | 51/298 |
| 5,256,170 | 10/1993 | Harmer et al. | 51/298 |
| 5,282,900 | 2/1994 | McDonell et al. | 134/2 |
| 5,306,319 | 4/1994 | Krishnan et al. | 51/298 |
| 5,308,673 | 5/1994 | Tochacek et al. | 428/102 |
| 5,346,516 | 9/1994 | Alkhas et al. | 51/298 |

FOREIGN PATENT DOCUMENTS

| | | | |
|---|---|---|---|
| 0 239 126 | 9/1987 | European Pat. Off. . | |
| 64-45576 | 2/1989 | Japan . | |
| 779358 | 7/1957 | United Kingdom . | |
| 1137556 | 12/1968 | United Kingdom | B24D 11/02 |
| 2 017 485 | 10/1979 | United Kingdom | A47L 17/08 |
| 2 057 483 | 4/1981 | United Kingdom . | |

OTHER PUBLICATIONS

PCT International Search Report, International Application No. PCT/US95/13178.

*Primary Examiner*—Timothy V. Eley
*Assistant Examiner*—Derris H. Banks
*Attorney, Agent, or Firm*—Gary L. Griswold; Walter N. Kirn; Daniel R. Pastirik

[57] ABSTRACT

Abrasive articles and methods for their manufacture are described. The articles are screen abrasive articles including a durable backing member having a patterned array of portions thereon arranged around a plurality of openings extending through the backing with the openings comprising between about 20% and about 80% of the total area of the backing. A coating of abrasive material is adhesively affixed to the array of portions on the backing, forming abrasive surfaces arranged around the openings to cooperatively function as a single abrasive surface while the openings allow debris to pass through the article during abrasive applications. In at least one aspect of the invention, the portions of the backing include a plurality of first surface portions and a plurality of second surface portions having surface areas greater than the surface areas of the first portions.

27 Claims, 4 Drawing Sheets

ABRASIVE ARTICLES AND METHODS FOR THEIR MANUFACTURE

The present invention relates to novel abrasive articles having a layer of abrasive material bonded to a backing or a substrate and to methods for the manufacture of such articles. More specifically, the invention relates to abrasive articles known as "screen abrasives" having a system of repetitive abrasive surfaces arranged around a plurality of openings extending through the article. The system of abrasive surfaces comprises discrete portions which collectively function as an effective abrasive surface having a total surface area greater than conventional screen abrasives.

BACKGROUND OF THE INVENTION

Screen abrasives for grinding and surface preparation applications are typically made with an abrasive layer adhered to the fibers of a woven or knitted backing. Both the backing and the finished article have an open mesh or screen-like construction with a plurality of openings extending through the abrasive article to direct debris away from the surface of the workpiece. The mesh structure allows for the passage of debris away from the treated surface and, consequently, is effective in reducing the problem of loading during abrasive applications which generate a high volume of debris. As used herein, "loading" refers to the tendency for the pores and the interstitial spaces of the abrasive article to clog due to retained debris created during an abrasive application. Plaster and paint sanding applications, for example, typically generate enough debris to clog a conventional abrasive article (e.g. a nonscreen article), substantially diminishing its effectiveness in certain applications. The open mesh construction of the screen abrasives, however, has been known to reduce such loading problems in those applications.

In spite of the aforementioned advantages, screen abrasives have not enjoyed widespread use in abrasive applications because of noted shortcomings. One noted problem is that screen abrasives provide only low stock removal rates in many abrasive applications. Although the open mesh construction of screen abrasive articles is known to reduce the aforementioned loading problems, this advantage has been achieved at the expense of grinding and abrasive efficiency. Because of their open mesh construction, screen abrasive designs have generally failed to provide an abrasive surface with a surface area substantial enough to provide stock removal rates comparable to those of the nonscreen or more standard coated abrasive articles. Consequently, screen abrasives have been used in only a limited number of applications.

Although the aforementioned problems have been known for some time, the art has been unable to provide suitable solutions. It is known, for example, that the surface area of a screen abrasive can be improved slightly by controlling the fiber denier and/or the thread count of the backing. However, efforts to significantly increase the effective surface area of screen abrasives by controlling either the fiber denier or the thread count have not significantly improved either the stock removal rate or the resulting finish on the workpiece. Accordingly, there is a recognized and unfulfilled need for improved screen abrasive articles and for methods for the manufacture of such improved articles.

It would be desirable, therefore, to provide abrasive articles capable of being used in a variety of abrasive applications. It would be desirable to provide such articles as screen abrasive articles adapted for use in a variety of applications including those which generate a high volume of debris as well as the more difficult abrasive applications previously known to be problematic for screen abrasive articles. It would be particularly desirable to provide an improved screen abrasive having a substantial abrasive surface area which is greater than the effective surface area of known screen abrasives. During a variety of abrasive applications, such an improved article would desirably demonstrate an improved stock removal rate while retaining the non-loading characteristics generally attributed to screen abrasive articles.

BRIEF DESCRIPTION OF THE INVENTION

The present invention overcomes the noted problems of prior art screen abrasives by providing novel and inventive screen abrasive articles and methods for their manufacture. The screen abrasive articles of the invention are constructed with a backing having a repetitive array of surface areas organized around a plurality of openings which extend through the backing. The array of surface areas provides a substantial surface area onto which an abrasive layer can be adhered.

In one aspect of the invention, a screen abrasive article is provided comprising: a backing having a plurality of first portions and a plurality of second portions, said second portions having a surface area greater than the surface area of said first portions, said first and said second portions arranged around a plurality of openings extending through said backing; and a coating of abrasive material adhesively affixed to said backing forming first and second abrasive surfaces thereon, said first and second surfaces arranged around said openings to cooperatively function as a single abrasive surface while said openings allow debris to pass therethrough.

In another aspect of the invention, a preferred screen abrasive article comprises: a backing having a patterned array of portions arranged around a plurality of openings extending through said backing, said openings comprising between about 20% and about 80% of the total surface of said backing; a coating of abrasive material adhesively affixed to said array of portions, forming abrasive surfaces arranged around said openings to cooperatively function as a single abrasive surface while said openings allow debris to pass therethrough.

Preferably, the backing is a knitted substrate made using a warp knitting, weft filled technique wherein the warp fibers (those running in the machine direction) are chain stitched and wherein the weft fibers (those running in the cross direction) are inserted or inlaid among the warp fibers.

The invention also includes methods for the manufacture of the above articles. In still another aspect of the invention, a preferred method for the manufacture of such articles, comprises: providing a backing material having a patterned array of portions arranged around a plurality of openings extending through said backing, said openings comprising between about 20% and about 80% of the total area of said backing; applying an abrasive layer to said backing, said abrasive layer adhesively affixed to said array of portions, forming abrasive surfaces on said portions and retaining said openings; and forming said backing into an abrasive article after said abrasive layer has been applied thereto.

Those skilled in the art will more fully appreciate the details of the present invention upon a consideration of the remainder of the disclosure, including the detailed description of the preferred embodiments and the appended claims.

BRIEF DESCRIPTION OF THE DRAWINGS

In describing the details of the preferred embodiments of the invention, reference is made to the various figures wherein.

DETAILED DESCRIPTION OF THE PREFERRED EMBODIMENTS

Figure 1:
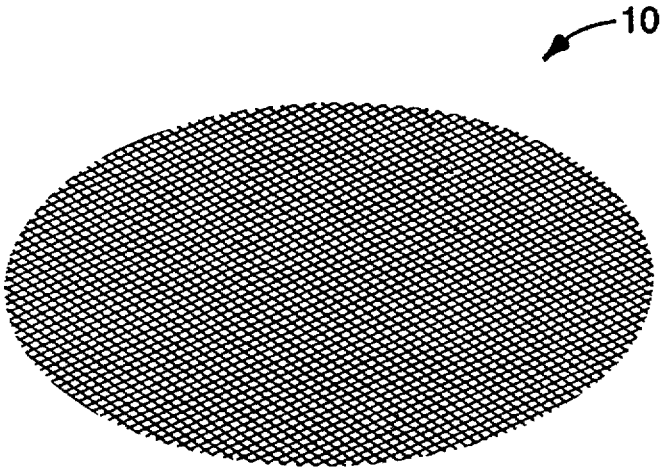
Fig. 1 PRIOR ART
FIG. 1 is a perspective view of a prior art disc-shaped screen abrasive article.

Details of the preferred embodiments of the invention are now to be described in some detail. It will be understood by those skilled in the art that the details of the embodiments discussed below are not limiting in any way but are merely illustrative of the features of the invention. In describing the preferred embodiments, reference is made to the various figures wherein the structural features of the invention are identified by reference numerals and wherein identical reference numerals indicate identical structures.

Figure 2:
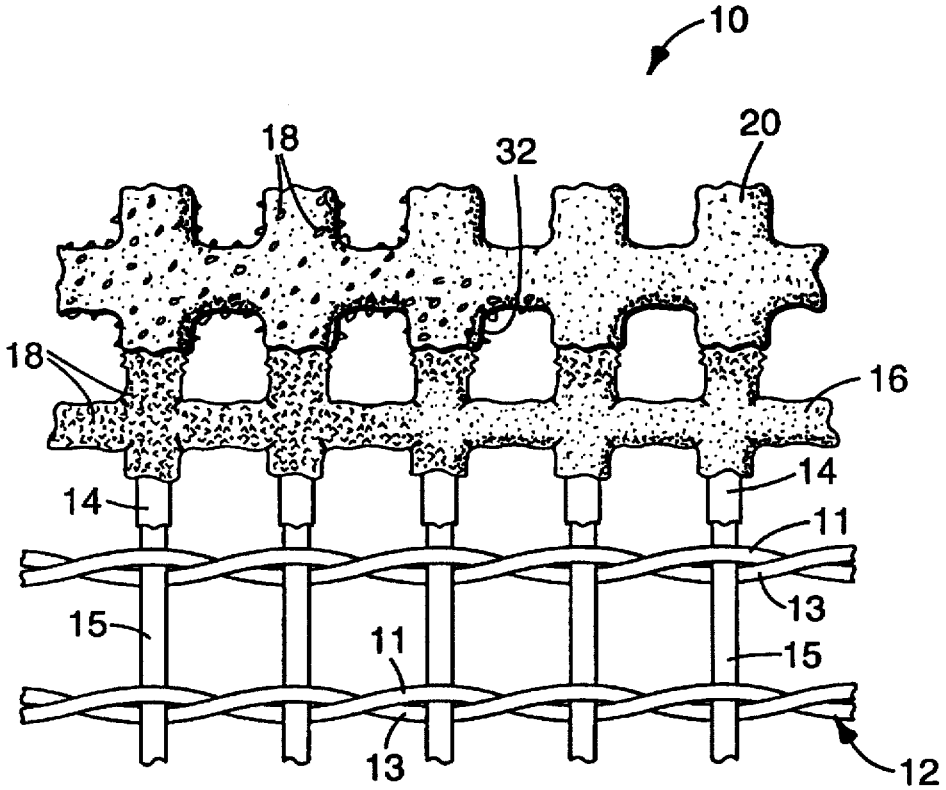
Fig. 2 PRIOR ART
FIG. 2 is an enlarged view of a segment of the screen abrasive article of FIG. 1 with parts removed to show detail.

Referring now to the figures, FIGS. 1 and 2 illustrate a screen abrasive article 10 known in the prior art. The article 10 includes an open mesh backing 12 which is typically a woven backing such as the leno weave fabric shown in FIG. 2 with warp yarns 11 and 13 twisted together and fill yarns 15 passing therebetween. The backing 12 is treated with a pre-size or saturant treatment to form a sealing layer 14 over the yarns 11, 13 and 15. The sealing layer 14 is water resistant and water insoluble to seal the backing against moisture and also to provide added dimensional stability by adhering the yarns 11, 13 and 15 to one another at their points of intersection. The sealing layer 14 can be made from any of a variety of materials known to those in the field. Most typically, a latex or a latex/phenolic blended adhesive material is used. The layer 14 provides a surface which is chemically and physically compatible with other resinous adhesives which are applied thereover.

A first resin or adhesive layer is applied over the presize layer 14 of the backing to form a make coat 16. The make coat 16 is preferably made of a resinous adhesive material, most typically a phenolic resin, for example. The make coat 16 is then treated with a mineral coat of abrasive particles 18 which can be selected from a group of abrasively effective materials as discussed below. An additional coat of adhesive material or size coat 20, typically the same phenolic resin used in the make coat 16, or one which is similarly blended, is applied over both the make coat 16 and the abrasive particles 18 so that the particles 18 are anchored within the two resinous adhesive layers 16 and 20 to form an abrasively effective surface. Optionally, an anti-loading adhesive layer (not shown) can be applied over the size coat 20. In abrasive applications, the openings 32 permit debris or swarf to pass through the article 10 and away from the workpiece. Prior art screen abrasives such as the article 10 provide stock removal rates which have been lower in many applications than the stock removal rates of nonscreen or more conventional coated abrasives.

Figure 3:
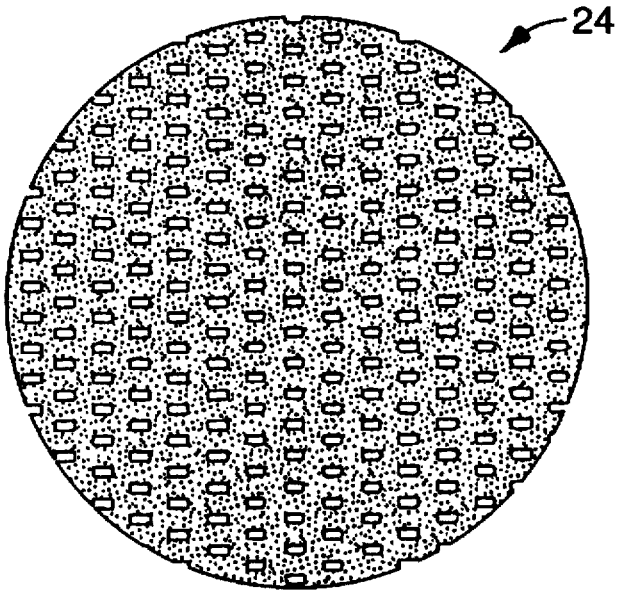
FIG. 3 is a plane view of a major surface of a screen abrasive article according to a first embodiment of the present invention.
Figure 4:
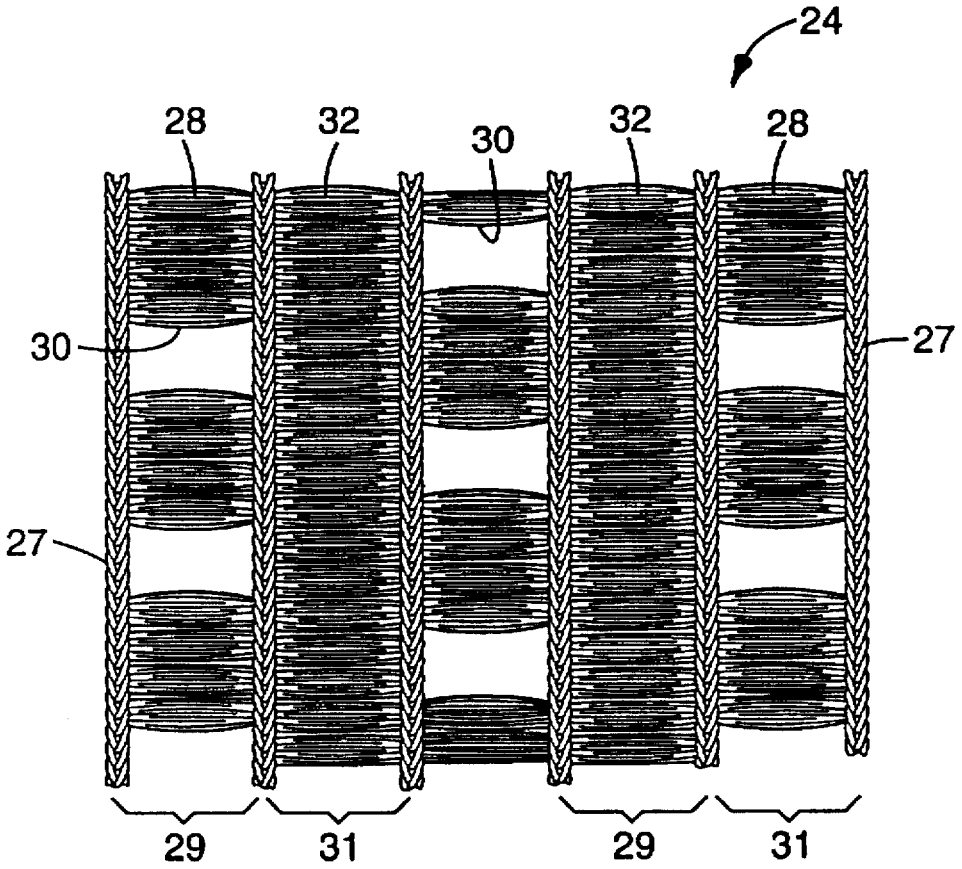
FIG. 4 is an enlarged plane view of a portion of a knifed substrate suitable for inclusion within the abrasive article of FIG. 3.
Figure 5:
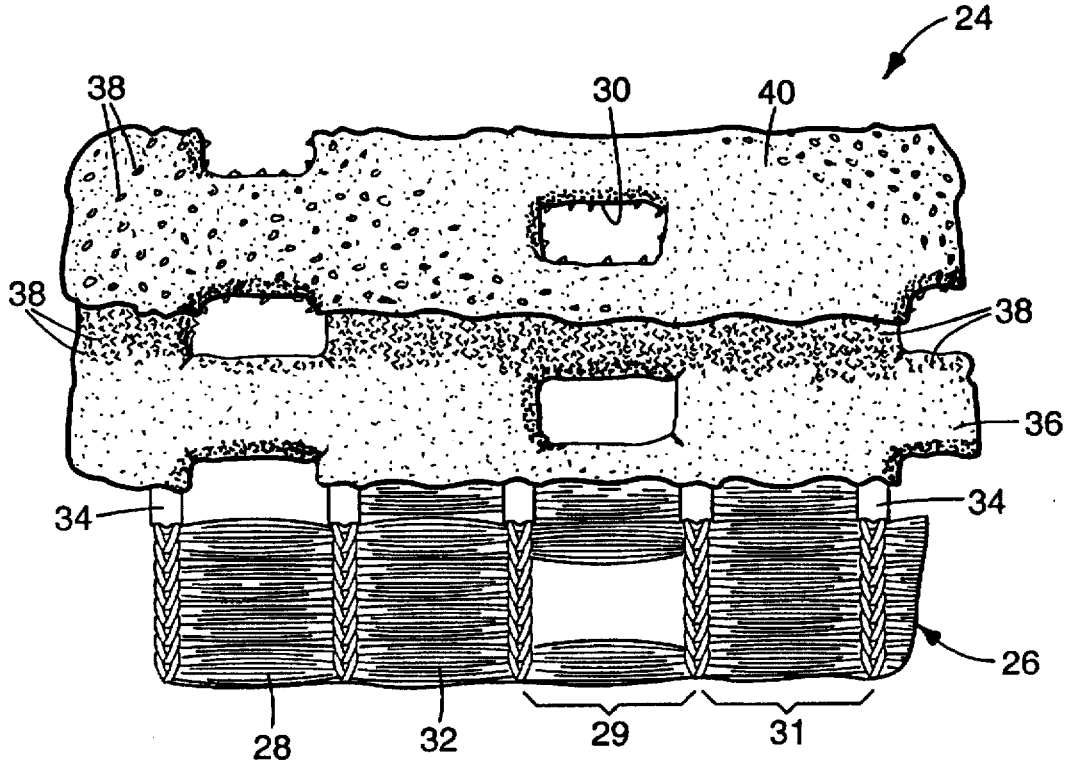
FIG. 5 is an enlarged plane view of a segment of the abrasive article of FIG. 3, partially cut away to reveal the knitted substrate of the type shown in FIG. 4.

Referring now to FIGS. 3, 4 and 5, a first preferred embodiment of a screen abrasive article 24 according to the present invention is shown. The article 24 includes a backing or substrate 26 (FIG. 4) with portions 28 and 32 surrounding a plurality of openings 30 extending through the backing 26. The first portions 28 are aligned within the backing 26 between the chain stitching 27 in a first set of columns 29 extending in the warp (or machine) direction and separating adjacent openings 30. The first portions 28 provide a plurality of first surfaces for the application of abrasive material thereon. Second portions 32 are also arranged between the stitching 27 in a second set of alternating columns 31 extending in the warp direction between columns 29 including the openings 30 and first portions 28 included therein. As is discussed in more detail below, the first and second portions 28 and 32, respectively, form a systematic array of surface portions around the openings 30 to collectively provide a substantial surface area onto which an abrasive layer can be affixed.

As shown, the second portions 32 may have second surface areas greater than the surface areas of the first portions 28. However, it is not intended that the invention be limited by the relative surface areas of the portions 28 and 32. Rather, the portions 28, 32 are merely illustrative of an aspect of an improved screen abrasive article which provides an enhanced abrasive surface area.

It is contemplated that the backing 26 can be made from materials which, when included within an abrasive article, will be strong and durable in abrasive applications. Both woven and knitted backings are contemplated within the scope of the invention as well as backings made by other techniques which will provide a substantial surface area to form an effective abrasive article under the broadest teachings of the invention. In selecting between a woven or a knitted backing, a knitted backing is preferred and, more preferably, the backing is a knitted substrate which is warp-knitted and weft-filled. The warp-knitting, weft-filled knitting process includes those in which the warp fibers, running in the machine direction, create a chain-stitch, while the weft fibers, running in the cross direction, are inserted or inlaid among the warp fibers. As those skilled in the art will appreciate, such a knitting technique is preferred because it allows for the pattern of the backing to be easily altered, as may be required in certain applications.

In a preferred knitting technique for use in the manufacture of a suitable backing, the pattern of the backing 26 is controlled by the weft or cross-web yarns which can be inserted to traverse the entire width of the substrate or backing 26 or can be short or partially inlaid to traverse only a small number of warp yarns. The weft fibers can traverse from one warp yarn to the next or traverse across three warp yarns, depending on the desired pattern. The backing 26 is a three bar warp knit fabric made of 100% polyester fibers. The backing 26 is manufactured on a commercial knitting machine such as a "Raschel" warp knitting machine, for example, wherein two ply yarns are positioned on each bar of the machine (not shown) and each of the yarns is a 150 denier, 33 filament textured polyester. The substrate has one yarn knit on one bar with a 2-0, 0-2 pattern, another yarn knit on a second bar with a 0-0, 4-4, 0-0, 6-6, 2-2, 6-6 pattern and the third yarn knit on a third bar with a 6-6, 2-2, 6-6, 0-0, 4-4, 0-0 pattern. Those skilled in the art will appreciate that variations to the pattern of the backing 26 by the inclusion of weft or cross-web yarns are numerous and are also within the scope of the invention. Backings like the backing 26 of FIG. 4, for example, are commercially available and can be obtained from Milliken and Company of Spartanburg, S.C. as a carpet underlayer fabric.

In the untreated backing, optimizing the surface area available for the application of an abrasive layer is an important aspect of the invention. To this end, the total surface area of the combined first and second portions 28 and 32, respectively, is optimized while providing openings 30 which are adequate to allow the passage of debris therethrough during an abrading application. In this aspect of the invention, backings having openings 30 making up between about 20% and about 80% of the total area of at least one side of the backing 26 are satisfactory. In general, the more difficult grinding applications will often require an article 24 having a larger effective surface area (e.g. the openings 30 make up a smaller percentage of the total area) and, the less difficult applications can be more easily accomplished with an article 24 having a smaller effective grinding surface (openings 30 are a higher percentage of the total area). However, it has been found that when the openings comprise less than about 20% of the total area of the backing, significant loading tends to occur during use. At areas of openness exceeding about 80%, the finished abrasive article often lacks sufficient strength and does not have enough surface area to perform in a satisfactory manner in abrasive applications. Within the above surface area parameters, untreated backings having open areas 30 with axial dimensions varying from about 0.5 mm to about 20 mm are satisfactory. Backings with openings 30 having an axial measure of about 3 mm have provided the desired degree of openness within the above parameters in wood and acrylic grinding applications, as is described in the Examples herein.

The backing 26 can be made from any of a variety of yarns or filaments spun from monofilaments or from staple filaments and the scope of the invention is not to be limited to require one or more varieties of fibers over any other. The filaments can be extruded or can include a woven sheath surrounding an extruded core. The fibers and/or filaments used in the present invention include those which are synthetic, natural, organic or inorganic, including cotton, silk, hemp, jute or rubber, for example. Organic materials such as thermoplastic and thermosetting materials can be used and include, without limitation, polyamides (such as nylon), polyolefins, polyurethanes, aramides, viscose (such as rayon), polyesters, and the like. Exemplary of inorganic materials that can also be included in the backing are metallic fibers of aluminum or steel or ceramic fibers including glass and fiberglass. These fibers can be textured or smooth. Unless otherwise stated, the term "fiber", as used herein, is to be broadly construed to include any type of yarn or filament including twisted filaments.

The use of yarns or fibers of a certain denier can also affect the overall suitability of the backing made therefrom. As is known to those in the art, denier is a unit of fiber fineness based upon a standard of a mass per unit length and, as used herein, shall be understood to be based upon the standard of 50 milligrams per 450 meters of fiber. In general, the denier of the yarn or fibers within the backing can vary over a broad range, most typically from between about 15 and about 600 denier. More preferably, the yarn denier will be between about 100 and about 300 denier. The number of filaments per yarn and the denier of each filament can also vary over broad ranges while remaining within the scope of the invention. Preferred are those yarns having between about 2 and about 50 filaments in each strand of yarn used in the backing 26. The denier of the filaments within each fiber or yarn can range from between about 2 and about 100 and, more preferably, between about 10 and about 30 denier. It is also contemplated that the backing of abrasive articles according to the present invention can include combinations of yarn and filament deniers within the same backing.

As used herein, the "gauge" of a substrate shall be understood to be the number of warp yarns per centimeter while the "stitch density" is the number of weft or fill yarns per centimeter. Backing substrates having a gauge of between about 2 and about 30 are suitable for use in the abrasive articles of the invention. More preferably, the gauge will be between about 10 and about 20. Stitch density for the backing substrate will preferably be approximately equal to the gauge, i.e. generally within the range of between about 2 and about 30.

As is known, an optional but preferred step in the manufacture of the article 24 is to treat the knitted backing substrate 26 with a sealant or pre-size material prior to applying an abrasive coating thereto. The pre-size coating 34 provides several known advantages in the manufacture of abrasive articles. For example, the pre-size coat 34 seals the fibers of the backing against moisture, provides dimensional stability by fixing the fibers within the backing 26 to one another at their points of intersection and protects the fibers of the backing 26 from degradation caused by the resinous adhesive used in the abrasive coating. When the treated backing 26 (including the pre-size coat 34) is included within a completed article 24, the backing is usually much less brittle than it would otherwise be in the absence of such a coating 34. The pre-size coat is made from a known material, typically a latex based adhesive or a latex/phenolic blend which is applied to at least one of the major surfaces of the backing 26 to have a coating weight within a certain range, preferably between about 0.00343 grams per square centimeter ($g/cm^2$) and about 0.00972 $g/cm^2$. One acceptable latex adhesive is commercially available under the trade designation "Hycar 26091" from B. F. Goodrich. Other materials can be used as are known to those in the art. The treated backing 26 is typically stressed, in a tenter frame or the like, and the coating 34 is allowed to cure. In this manner, the coating 34 provides a backing 26 onto which a layer of adhesive can then be applied.

The pre-sized backing 26 is next treated with a resinous adhesive to form a make coat 36 thereover. The make coat 36 is typically made of a phenolic resin which is applied in a liquid or flowable form to at least one and usually both sides of the backing 26 to provide a coating weight preferably within the range from about 0.0122 $g/cm^2$ to about 0.020 $g/cm^2$. A plurality of abrasive particles 38 are next applied to the make coat 36 by a known technique such as drop coating or electrostatic coating. Preferably, the particles 38 are projected onto the make coat 36 using an electrostatic coating technique. The particles are applied at a coating weight preferably between about 0.0952 $g/cm^2$ and about 0.1586 $g/cm^2$. The make coat 36 is at least partially cured or solidified, and a size coat 40 is applied over the abrasive particles 38. The make coat 36 and the size coat 40 are then fully solidified or cured in a known manner. Like the make coat 36, the size coat 40 is typically made from a phenolic adhesive resin. The preferred coating weight for the size coat 40 is within the range from about 0.0453 $g/cm^2$ and about 0.0755 $g/cm^2$. The make and size coats are applied to the presized backing 26 using a known technique, such as roll coating, spray coating, curtain coating and the like. The resinous adhesives of both the make and size coats can be cured or solidified by a suitable treatment such as by drying or by exposure to an energy source such as a heat source, or any suitable radiation source such as an electron beam, ultraviolet light, visible light, x-rays and the like. Optionally, a super-size coat (not shown) can be applied over the size coat 40 to enhance the non-loading features of the finished abrasive article. The super-size coat can be provided in one of several forms as is known to those skilled in the art. For example, the super-size coat can be an aqueous solution of an anti-loading additive such as a stearate (usually zinc stearate at a concentration of about 25% by weight). Alternatively, the super-size coat can include the aforementioned stearate in a phenolic resin along with cryolite and/or other additional grinding aids.

It will be appreciated that the scope of the invention is not to be limited by the manner in which the abrasive coating is applied to the backing. As used herein, "abrasive coating" refers to the combined layers of make coat, abrasive particles, and size coat. Notwithstanding the procedure discussed above, it is also contemplated that the abrasive coating can be applied as a slurry wherein abrasive particles are dispersed in a resinous binder precursor. The slurry is applied to the backing by roll coating, spray coating, knife coating and the like, and is typically applied directly to the pre-sized backing. Following curing of the slurry material, a super-size coat may then be applied over the cured or hardened abrasive coat.

The abrasive particles used in making abrasive articles according to the present invention include all known abrasive materials as well as combinations and agglomerates of such materials. The abrasive particles typically will have an average particle size ranging from between about 4 and about 1300 micrometers (3000 to 16 grit) and possibly between about 12 and about 500 micrometers (1000 to 40 grit). Included among the various types of abrasive materials useful in the present invention are particles of aluminum oxide including ceramic aluminum oxide, heat-treated aluminum oxide and white-fused aluminum oxide; as well as silicon carbide, alumina zirconia, diamond, ceria, cubic boron nitride, garnet, and combinations of the foregoing. It is contemplated that the abrasive layer could include abrasive agglomerates such as those described in U.S. Pat. Nos. 4,652,275 and 4,799,939, the disclosures of which are incorporated herein by reference.

As mentioned, the make and size coats, as well as the possible super-size coats, are adhesive binders and may be formed from either thermoplastic or, preferably, from thermosetting resin adhesives. Resinous adhesives suitable for use in the present invention include phenolic resins, aminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof. Catalysts and/or curing agents may be added to the binder precursor to initiate and/or accelerate the polymerization process.

Preferably, the adhesive materials used in the present invention are phenolic resins such as resole and novolac resins, described in Kirk-Othmer, *Encyclopedia of Chemical Technology*, 3d Ed. John Wiley & Sons, 1981, New York, Vol. 17, pp. 384–399, incorporated by reference herein. Resole phenolic resins are made with an alkaline catalyst and a molar excess of formaldehyde, typically having a molar ratio of formaldehyde to phenol between 1.0:1.0 and 3.0:1.0. Novolac resins are prepared under acid catalysis and with a molar ratio of formaldehyde to phenol less than 1.0:1.0. A typical resole resin useful in the manufacture of articles of the present invention contains between about 0.75% (by weight) and about 1.4% free formadehyde; between about 6% and about 8% free phenol; about 78% solids with the remainder being water. The pH of such a resin is about 8.5 and the viscosity is between about 2400 and about 2800 centipoise. Commercially available phenolic resins suitable for use in the present invention include those known under the trade designations "Durez" and "Varcum", available from Occidental Chemicals Corporation (N. Tonawonda, N.Y.); "Resinox", available from Monsanto Corporation; and "Arofene" and "Arotap", both available from Ashland Chemical Company.

Optional ingredients which can be included in the formulation of the abrasive coatings include fillers, grinding aids, fibers, lubricants, wetting agents, surfactants, pigments, anti-foaming agents, dyes, coupling agents, plasticizers, suspending agents, antistatic agents, and the like. Examples of filler materials suitable for use in the articles of the present invention include without limitation calcium carbonate, calcium metasilicate, silica, silicates, sulfate salts, and combinations thereof. Suitable grinding aids include cryolite, ammonium cryolite, and potassium tetrafluoroborate, for example.

After the backing has been coated with both the make and size coats (and possibly a super-size coat), the resins are thoroughly cured prior to forming the abrasive article into its final desired configuration such as sheets, discs (e.g.,as shown in FIG. 3), rolls and the like. The total surface area on screen abrasive sheets (including the openings therein) can vary from between about 1 $cm^2$ and about 10,000 $cm^2$ and, preferably, between about 100 and about 1000 $cm^2$ Discs can be shaped to have a diameter preferably between about 2.54 cm to about 61 cm, and usually about 41 cm.

Figure 6:
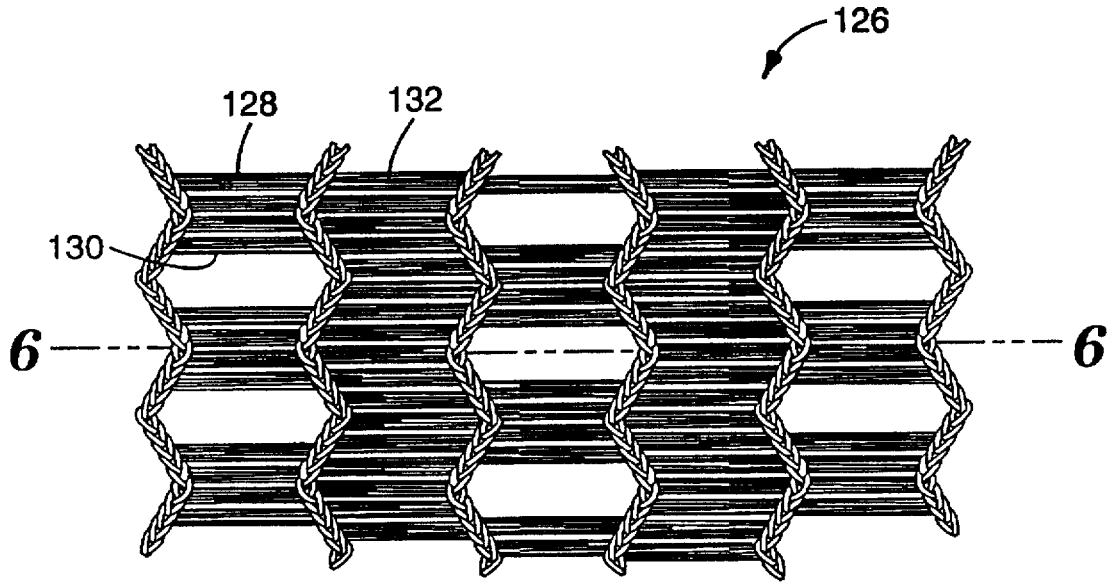
FIG. 6 is an enlarged view of a segment of the knitted substrate of FIG. 4, stretched in a direction along line 6—6 to create a configuration suitable for inclusion in an abrasive article according to a second embodiment of the present invention.

Referring now to FIG. 6, a second configuration of the backing 26 of FIGS. 3, 4 and 5 is shown. The backing 126 is identical to the backing 26 of FIG. 4 except that backing 126 has been stretched in the weft direction to reshape the surface areas of the first and second portions 128 and 132, respectively. It has been noted that the configuration of the openings 130 within the backing 126 can provide a finished article possessing improved nonloading characteristics. In knitted backings, for example, the configuration of the openings 130 can easily be varied to provide a backing and a finished article with non-square openings, such as the hexagonal openings 130. In general, it is believed that non-square and circular openings will exhibit better non-loading characteristics in a screen abrasive during use. In practice, circular openings may be difficult to manufacture and, openings having a hexagonal configuration have been found to be suitable. Although the shape of the particular openings in the backing 126 can be controlled to some extent during the knitting process, the knitted backing 126 is more easily manufactured with square or rectangular openings which are then stretched either prior to or after the application of the pre-size material on the backing. In this manner, the square openings 30 (FIG. 4) can be reshaped and set into a hexagonal or other desired configuration prior to the addition of an abrasive coating over the backing. In all other respects, articles made with the backing 126 are identical to those already described.

It will be appreciated, however, that the invention encompases variations in the shape and the manner in which the openings are formed. It is contemplated that articles of the invention can be made to include a wide variety of uniquely shaped openings which are geometric as well as non-geometric in their configuration. These openings may be set in a final configuration during the knitting process or they may be configured subsequently in the same manner as that described with respect to the formation of the openings 130, for example.

Figure 7:
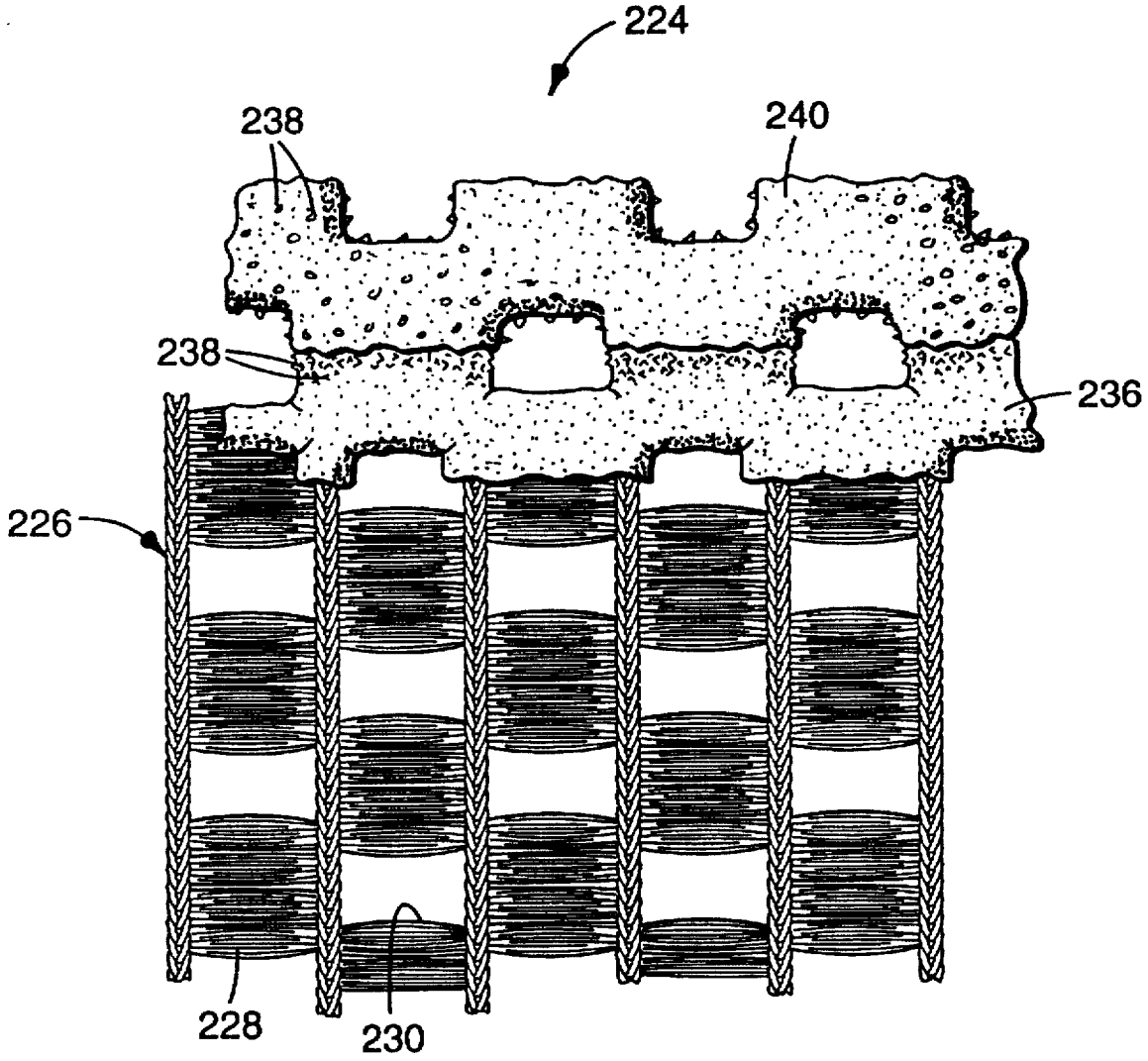
FIG. 7 is an enlarged plane view of a segment of a third embodiment of an abrasive article according to the present invention with parts cut away to reveal the fabric substrate.

Referring now to FIG. 7, a third embodiment of the invention, in section, is depicted and will now be described. Except as otherwise noted, the structural features of this third embodiment are identical to those described above and will not be repeated. The article 224 includes a knitted backing 226 having an array of areas 228 forming a checkerboard-like pattern around openings 230. The areas 228 are substantially identical to each other, allowing for variations in the knitting technique employed. As in the other embodiments described above, the backing 226 is preferably treated with a presize layer (not shown) and an abrasive coating is applied thereover. The abrasive coating will include the aforementioned make and size coats 236 and 240, respectively, with abrasive particles 238 anchored therewithin. An optional supersize coating (not shown) can be applied over the size coat 240. The areas 228 form an abrasively effective surface when coated with an abrasive layer with areas of openness 230 extending through the article 224 to allow for the passage of debris therethrough during abrasive applications.

The screen abrasive articles of the invention may be used in a variety of applications and will exhibit improved abrasive performance when compared with conventional prior art screen abrasive products. The openings within the articles are designed to provide passageways for debris generated during the abrading process, thereby providing a mechanism for the removal of debris from the interface between the abrasive article and the workpiece. The articles of the invention can be used dry or wet and, wet applications can be performed under a flood of water or other coolant or under a light mist, depending on the application. The proposed uses for the articles of the invention include without limitation paint sanding, dry plaster or wallboard sanding, wood floor sanding, stone polishing, plastic grinding and other grinding applications known by those skilled in the art.

The following examples are illustrative of the construction and the performance characteristics of the screen abrasive articles described herein.

EXAMPLE 1

An abrasive article was prepared. The backing for the article was made using a commercially available polyester warp knitted material as shown in FIG. 4 (obtained from Milliken & Company) having approximately 2.3 warp yarns per cm and approximately 8.7 weft or fill yarns per cm (6×22 warp/fill or weft yarns per inch). The backing was coated with a latex adhesive primer available from B. F. Goodrich under the trade designation "Hycar 26091" to form a sealing layer with a wet coating weight of 0.00628 g/cm$^2$. Prior to coating with the primer, the backing was approximately 25% open with the opened areas measuring about 3 mm by about 2 mm, resembling the pattern shown in FIG. 4 herein. After application of the sealing layer, the backing was stressed to maintain a taut configuration with a force of approximately 2.27 kg and the latex was cured at 135° C. for 3 minutes. The resulting backing was fairly stiff. A resole phenolic make coat was roll coated onto both sides of the presized backing to provide a wet coating weight of 0.0163 g/cm$^2$. 80 grit aluminum oxide abrasive particles were drop coated onto both sides of the backing and into the wet make coat providing an additional weight of abrasive particles of 0.1269 g/cm$^2$. A resole phenolic size coat was applied over the abrasive particles with a wet coating weight of 0.0604 g/cm$^2$ and the article was cured for five hours at 175° C.

EXAMPLE 2

A second article was prepared as in Example 1 except that a supersize coat was applied to the article. The supersize coat (or anti-loading adhesive layer) was prepared by dispersing zinc stearate in water at a concentration of about 23% by weight. The stearate solution was roll coated uniformly over the size coat and the article was oven dried at 220° F. (104° C.).

EXAMPLE 3

The articles of Examples 1 and 2 were tested for cut and cut retention using an acrylic (cellulose acetate butyrate polymer) workpiece and data was compared with that obtained for two prior art conventional screen abrasives. The prior art screen abrasive article included an 80 grit silicon carbide abrasive available from the Minnesota Mining and Manufacturing Company of St. Paul, Minn. under the trade designation "3M Sanding Screen"; and an 80 grit aluminum abrasive article sold under the trade designation "Pollinet Resin Bond" (type AA-80) from Koyo-Sha of Tokyo, Japan.

Each of the coated abrasive articles was cut into circular samples with approximate diameters of 10.2 centimeters. The discs were secured to a backup pad with a pressure sensitive adhesive and the pad was then secured to a drive plate of a Schiefer Abrasion Tester (available from Fraser Precision Company of Gaithersburg, Md.). Circular acrylic work pieces were employed for each of the abrasive articles tested. The workpieces were all approximately 10.16 cm in diameter and about 1.27 cm thick. Testing was done under a load of 4.5 kg under dry conditions. The initial weight of each workpiece was recorded and a coated abrasive disc was used to abrade the work piece for 500 cycles of the coated disc. An intermediate weight of the workpiece was taken to determine the amount abraded and the workpiece was then further abraded for an additional 500 cycles of the disc. The final weight of the workpiece was determined after 1000 cycles and both cut and cut retention values were tabulated for each of the screen discs. The comparative data is shown in Table I.

TABLE I

| Abrasive Disc | Total Cut 500 cycles (grams) | Total Cut 1000 cycles (grams) | Cut Retention[1] |
|---|---|---|---|
| Example 1 | 1.443 | 2.669 | 87% |
| Example 2 | 1.732 | 3.117 | 80% |
| "3M Sanding Screen"[2] | 0.744 | 1.400 | 88% |
| "Pollinet Resin Bond"[3] | 0.644 | 1.214 | 84% |

[1]Cut Retention = Total Cut(500 cycles)/Total Cut(1000 cycles)
[2]From Minnesota Mining and Manufacturing Company, St. Paul, Minnesota.
[3]Type AA-80 from Koyo-Sha of Tokyo, Japan.

The results shown in Table I generally show improved abrasive capabilities for the abrasive articles of Examples 1 and 2, both made according to the principals of the present invention. At 500 cycles, the sample of Example 1 showed a significantly higher total cut than either of the prior art screens. The sample of Example 2 (with its anti-loading layer) exhibited even greater cutting ability than the disc of Example 1. Similar improved results were obtained for the total cut after 1000 cycles with the disc of Example 1 giving total cut values of approximately twice those for the prior art samples. The total cut value for the disc of Example 2 also showed a significant increase after 1000 cycles.

EXAMPLE 4

An abrasive disc was prepared according to Example 1 and was tested for comparison with a "Pollinet Resin Bond" (type AA-80) screen abrasive. The discs were comparatively tested according to the method of Example 3 except that data was taken using two types of workpieces, two made of wood and one made of polymethylmethacrylate. The total cut on each workpiece was measured for 5000 cycles of the screen abrasive discs. The screen abrasive disc was the same as that used in Example 3 but, the other abrasive side was employed in this test. A polymethylmethacrylate workpiece and two new wood workpieces were prepared. Each side of each wood workpiece was used to run 2500 cycles of the abrasive disc being tested. The comparative data is set forth in Table II.

TABLE II

| Screen Abrasive Disc | Total Cut (grams) (polymethylmethacrylate workpiece) | Total Cut (grams) (Wood workpiece) |
|---|---|---|
| Example 1 | 3.330 | 2.600 |
| "Pollinet Resin Bond" (type AA-80) | 1.500 | 0.810 |

Again, the comparative data establishes the superior abrasive ability of the abrasive articles of the present invention. The total cut for the disc of Example 1 was more than twice that of the prior art disc on the polymethylmethacrylate workpiece and more than 3 times the total cut of the prior art disc on the wood workpiece.

While preferred embodiments of the present invention have been discussed and described in some detail above, those skilled in the art will appreciate that changes and modifications to the described embodiments can be made without departing from the true spirit and scope of the invention as defined in the following claims.

I claim:

1. An abrasive article, comprising:

a knitted backing comprising a plurality of chain stitched warp yarns and bundles of two or more weft fill yarns extending between adjacent chain stitched warp yarns, each said bundle providing a backing portion having a width greater than the width of the chain stitched warp yarns, with a plurality of openings extending through said backing between adjacent backing portions; and a coating of abrasive material adhesively affixed to each of said backing portions to provide a plurality of abrasive surfaces arranged around said openings, said abrasive surfaces cooperatively functioning as a single abrasive surface.

2. The abrasive article as defined in claim 1 wherein said backing is made from a material selected from the group consisting of knitted materials, woven materials, nonwoven materials and combinations thereof.

3. The abrasive article as defined in claim 1 wherein said plurality of openings have an axial measure within the range from about 0.5 mm to about 20 mm.

4. The abrasive article as defined in claim 1 wherein said each of said plurality of openings is hexagonally shaped.

5. The abrasive article as defined in claim 1 wherein said warp yarns and said weft yarns of said backing are composed of materials selected from the group consisting of polyamides, polyolefins, polyaramides, polyesters, cotton, silk, hemp, jute, rubber, metals ceramics and combinations thereof.

6. The abrasive article as defined in claim 5 wherein, said fibers have a denier within the range from about 15 to about 600.

7. The abrasive article as defined in claim 5 wherein, the gauge of said backing is within the range between about 2 and about 30.

8. The abrasive article as defined in claim 5 wherein, the stitch density of said backing is within the range between about 2 and about 30.

9. The abrasive article as defined in claim 1 wherein said patterned array of backing portions further comprise a plurality of first backing portions and a plurality of second backing portions, said second backing portions having a surface area greater than the surface area of said first backing portions.

10. The abrasive article as defined in claim 1 wherein said backing further comprises a presize material sealing at least a portion of said warp and weft yarns of said backing and said coating of abrasive material is adhered to said presize material.

11. The abrasive article as defined in claim 1 wherein said coating of abrasive material comprises an adhesive binder with abrasive particles dispersed therewithin.

12. The abrasive article as defined in claim 11 wherein said binder is a resinous thermosetting adhesive selected from the group consisting essentially of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

13. The abrasive article as defined in claim 11 wherein said abrasive particles comprise material selected from the group consisting essentially of particles of aluminum oxide, silicon carbide, alumina zirconia, diamond, ceria, cubic boron nitride, garnet, and combinations thereof.

14. The abrasive article as defined in claim 13 wherein said aluminum oxide is selected from the group consisting of ceramic aluminum oxide, heat-treated aluminum oxide, white-fused aluminum oxide, and combinations thereof.

15. The abrasive article as defined in claim 11 wherein said abrasive particles have a grit ranging from about 3000 to about 16.

16. A method for the preparation of an abrasive article, comprising:

providing a knitted backing material comprising a plurality of chain stitched warp yarns and bundles of two or more weft fill yarns extending between adjacent chain stitched warp yarns, each said bundle providing a backing portion having a width greater than the width of the chain stitched warp yarns, with a plurality of openings extending through said backing between adjacent backing portions;

applying an abrasive layer to said backing portions to form abrasive surfaces thereon around said openings; and forming an abrasive article after said abrasive layer has been applied to said backing.

17. The method as defined in claim 16 wherein said providing of a backing includes providing said backing portions to include a plurality of first backing portions and a plurality of second backing portions, said second backing portions having a surface area greater than the surface area of said first backing portions.

18. The method as defined in claim 16 wherein said providing of a backing includes arranging said portions around said openings such that said openings have an axial measure ranging from about 0.5 mm to about 20 mm.

19. The method as defined in claim 16 wherein said providing of a backing includes knitting said backing from fibers selected from the group consisting of polyarnides, polyolefins, polyaramides, polyesters, viscose, cotton, silk, hemp, jute, rubber, metals ceramics, and combinations thereof.

20. The method as defined in claim 19 wherein, said warp yarns and said weft yarns have a denier within the range from about 15 to about 600.

21. The method as defined in claim 20 wherein, the gauge of said backing is within the range from about 2 to about 30 and wherein the stitch density of said backing is within the range from about 2 to about 30.

22. The method as defined in claim 16 further comprising: stretching said backing to thereby reconfigure said openings from a rectangular configuration to a hexagonal configuration.

23. The method as defined in claim 16 wherein said providing of a backing material further comprises applying a presize material to said portions.

24. The method as defined in claim 16 wherein said applying of an abrasive layer to said backing portions comprises applying an adhesive binder with abrasive particles dispersed therewithin, said binder comprising a resinous thermosetting adhesive selected from the group consisting of phenolic resins, aminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

25. The method as defined in claim 24 wherein said abrasive particles comprise material selected from the group consisting of particles of aluminum oxide, silicon carbide, alumina zirconia, diamond, ceria, cubic boron nitride, garnet, and combinations thereof.

26. The method as defined in claim 25 wherein said aluminum oxide is selected from the group consisting of ceramic aluminum oxide, heat-treated aluminum oxide, white-fused aluminum oxide, and combinations thereof.

27. The method as defined in claim 25 wherein said abrasive particles have a grit ranging from about 3000 and to 16.

* * * * *

UNITED STATES PATENT AND TRADEMARK OFFICE

CERTIFICATE OF CORRECTION

PATENT NO. : 5,674,122
DATED : October 7, 1997
INVENTOR(S) : John E. Krech

It is certified that error appears in the above-identified patent and that said Letters Patent is hereby corrected as shown below:

Title page,
Under "Other Publications", insert -- Kirk-Othmer Encylocpedia of Chemical Technology, 3d Ed., John Wiley & Sons, 1981, New York, Vol. 17, pp. 384-399 --.

Column 3,
Line 9, "knifed" should read -- knitted --.

Column 8,
Line 30, "e.g.,as" should read -- e.g., as --.

Column 11,
Lines 59, 60, 61, 62, delete Claim 2.
Line 63, "Claim 3" should be renumbered -- Claim 2 --.
Line 66, "Claim 4" should be renumbered -- Claim 3 --.

Column 12,
Line 1, "Claim 5" should be renumbered -- Claim 4 --.
Line 4, "polyarnides" should read -- polyamides --.
Line 7, "Claim 6" should be renumbered -- Claim 5 --, and "claim 5" should be renumbered -- claim 4 --.
Line 10, "Claim 7" should be renumbered -- Claim 6 --, and "claim 5" should read -- Claim 4 --.
Line 13, "Claim 8" should be renumbered -- Claim 7 --, and "claim 5" should read -- claim 4 --.
Line 16, "Claim 9" should be renumbered -- Claim 8 --.
Line 22, "Claim 10" should be renumbered -- Claim 9 --.
Line 27, "Claim 11" should be renumbered -- Claim 10 --.
Line 30, "Claim 12" should be renumbered -- Claim 11 --, and "claim 11" should read -- claim 10 --.
Line 39, "Claim 13" should be renumbered --Claim 12 --, and "claim 11" should read -- claim 10 --.
Line 44, "Claim 14" should be renumbered --Claim 13 --, and "claim 13" should read -- claim 12 --.
Line 48, "Claim 15" should be renumbered --Claim 14 --, and "claim 11" should read -- claim 10 --.
Line 51, "Claim 16" should be renumbered -- Claim 15 --.
Line 66, "Claim 17" should be renumbered -- Claim 16 --, and "claim 16" should read -- claim 15 --.

UNITED STATES PATENT AND TRADEMARK OFFICE

CERTIFICATE OF CORRECTION

PATENT NO. : 5,674,122
DATED : October 7, 1997
INVENTOR(S) : John E. Krech

It is certified that error appears in the above-identified patent and that said Letters Patent is hereby corrected as shown below:

Column 13,
Line 5, "Claim 18" should be renumbered -- Claim 17 --, and "claim 16" should read -- claim 15 --.
Line 9, "Claim 19" should be renumbered -- Claim 18 --, and "claim 16" should read -- Claim 15 --.
Line 11, "polyarnides" should read -- polyamides --.
Line 15, "Claim 20" should be renumbered -- Claim 19 --, and "claim 19" should read -- claim 18 --.
Line 18, "Claim 21" should be renumbered --Claim 20 --, and "claim 20" should read -- claim 19 --.
Line 22, "Claim 22" should be renumbered --Claim 21 --, and "claim 16" should read -- claim 15 --.
Line 26, "Claim 23" should be renumbered --Claim 22 --, and "claim 16" should read -- claim 15 --.

Column 14,
Line 1, "Claim 24" should be renumbered -- Claim 23 --, and "claim 16" should read -- claim 15 --..
Line 13, "Claim 25" should be renumbered --Claim 24 --, and "claim 24" should read -- claim 23 --.
Line 18, "Claim 26" should be renumbered --Claim 25 --, and "claim 25" should read -- claim 24 --.
Line 22, "Claim 27" should be renumbered --Claim 26 --, and "claim 25" should read -- claim 24 --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*